United States Patent [19]

Rudick et al.

[11] Patent Number: 4,808,348

[45] Date of Patent: Feb. 28, 1989

[54] MICROGRAVITY CARBONATOR

[75] Inventors: Arthur G. Rudick; Kenneth G. Smazik, both of Marietta; Leonard F. Antao, Atlanta, all of Ga.

[73] Assignee: The Coca-Cola Company, Atlanta, Ga.

[21] Appl. No.: 49,569

[22] Filed: May 14, 1987

[51] Int. Cl.[4] ..... B01F 3/04

[52] U.S. Cl. ..... 261/82; 366/273; 261/DIG. 7

[58] Field of Search ..... 261/82, DIG. 7; 366/273, 274

[56] References Cited

U.S. PATENT DOCUMENTS

| | | | |
|---|---|---|---|
| 1,242,493 | 10/1917 | Stringham | 366/274 |
| 2,604,310 | 7/1952 | Brown | 261/DIG. 7 |
| 3,226,099 | 12/1965 | Black et al. | 261/82 |
| 3,622,129 | 5/1969 | Mazowski | 366/247 |
| 3,784,170 | 1/1974 | Petersen et al. | 366/273 |
| 4,199,265 | 4/1980 | Sanderson | 366/274 |
| 4,266,950 | 5/1981 | Makino et al. | 366/273 |
| 4,534,656 | 8/1985 | de Bruyne | 366/247 |
| 4,629,589 | 12/1986 | Gupta et al. | 261/34.1 |

FOREIGN PATENT DOCUMENTS

| | | | |
|---|---|---|---|
| 0014109 | 8/1980 | European Pat. Off. | 366/273 |
| 60-34727 | 2/1985 | Japan | 366/273 |

*Primary Examiner*—Tim Miles

*Attorney, Agent, or Firm*—Birch, Stewart, Kolasch, & Birch

[57] ABSTRACT

A carbonator system consisting of a holding tank divided into an upper and lower chamber may be used on earth or in the microgravity conditions of outer space. A first embodiment involves first introducing water and then carbon dioxide into the lower chamber of the holding tank. Pressure is then exerted on a moveable piston in this tank to cause the piston to reduce the volume of the lower chamber housing the carbon dioxide and water. This action plus the action of an agitator, drives the carbon dioxide into solution. An alternative embodiment is disclosed wherein carbon dioxide is first introduced into the lower chamber of the holding tank. Water is next introduced into this lower chamber such that it is completely filled with both water and carbon dioxide. While the water is being introduced, an agitator is used to aid mixing of this water and carbon dioxide to form carbonated water. The agitator may consist of a bar contained within the lower chamber of the holding tank. Circumferentially surrounding the holding tank, a series of electro-magnetic coils are provided. These coils influence the agitator bar via magnetic force to cause rotation of this bar about a longitudinal axis of the holding tank. This agitator may also be reciprocated along this longitudinal axis. A control system is also provided for operating the carbonator. This control system includes a microcontroller, piston position sensors, controllers for various valves and controls for the agitator.

27 Claims, 4 Drawing Sheets

MICROGRAVITY CARBONATOR

BACKGROUND OF THE INVENTION

1. Field of the Invention

The present invention relates to a carbonator system, a control system and an agitator for use either on earth or in the microgravity conditions of outer space. The carbonator system provides for mixing of carbon dioxide and water to form carbonated water under the principle that if a specific mass of carbon dioxide is forced into a specific amount of water, the water will be carbonated to a specific level. A control system and an agitator are provided to aid in mixing the water and carbon dioxide to form this carbonated water.

2. Description of the Background Art Various carbonator systems for carbonating water are known in the art. For instance, U.S. Pat. No. 2,604,310 to Brown illustrates a carbonator tank which is supplied with a fixed amount of water and a fixed amount of carbon dioxide gas from a positive displacement pump. A known arrangement for carbonating water in the microgravity conditions of outer space is disclosed in U.S. Pat. No. 4,629,589 to Gupta et al. and entitled "Beverage Dispening System Suitable for Use in Outer Space", assigned to the same assignee as the present invention. Accordingly, a need in the art exists for additional forms of carbonator systems which are suitable for use in the microgravity conditions of outer space as well as on earth. Such an arrangement must insure that only carbonated water and no bursts of carbon dioxide gas are dispensed in the absence of gravity.

SUMMARY OF THE INVENTION

Accordingly, it is the primary object of the present invention to provide a carbonator system which will operate in the zero gravity conditions of outer space as well on earth.

It is another object of the present invention to provide a carbonator system which avoids dispensing bursts of carbon dioxide gas.

It is a further object of the present invention to provide a carbonator system which drives a fixed amount of carbon dioxide into solution to form carbonated water with no free gas remaining.

It is yet another object of the present invention to provide a carbonator system which does not require positive displacement metering pumps for supplying water and carbon dioxide to the carbonator.

It is still another object of the present invention to provide a carbonator system with an agitator which is simple in construction and has few moving parts.

It is a futher object of the present invention to provide a carbonator system which is suitable for use in outer space, which is highly reliable and requires limited maintenance.

These and other objects of the present invention are fulfilled by providing a carbonator system for producing carbonated water comprising a holding tank means for holding at least water and carbon dioxide, a movable piston separating said holding tank means into two chambers, a first chamber for holding a propellant fluid and a second chamber for holding carbon dioxide and water and control means for controlling flow of propellant fluid into and out of said first chamber and controlling flow of carbon dioxide and water into said second chamber, at least one of said carbon dioxide and water being received in said second chamber as said propellant fluid is discharged from said first chamber, said control means permitting said water and carbon dioxide to be held in said second chamber for sufficient time with sufficient agitation to form carbonated water and said control means controlling discharge of carbonated water formed from said water and carbon dioxide from said second chamber.

These and other objects of the present invention are also fulfilled by providing a control system for a carbonator having a first and second chamber wherein carbon dioxide and water are mixed in said second chamber to form carbonated water, said system comprising, control means for directing operation of said carbonator, a first valve for permitting propellant fluid to enter said first chamber when said first valve is open, a second valve for permitting propellant fluid to exit said first chamber when said second valve is open, a third valve for permitting said water to enter said second chamber when said third valve is open, a fourth valve for permitting said carbon dioxide to enter said second chamber when said fourth valve is open, a fifth valve for permitting said carbonated water formed from said water and carbon dioxide to exit said second chamber when said fifth valve is open, and means to interface the control means with the first, second, third, fourth and fifth valves to enable said control means to open and close said valves.

Furthermore, these and other objects of the present invention are additionally fulfilled by providing an agitator for a carbonator for mixing carbon dioxide and water to form carbonated water, said agitator aiding the formation of carbonated water and comprising a plurality of electro-magnetic coils surrounding the carbonator, an agitator mixing bar disposed in said carbonator, said bar having a magnetic north pole and a magnetic south pole and having a rotational axis, and control means for directing operation of said agitator, said control means selectively activating and deactivating each of said electro-magnetic coils to cause said mixing bar to rotate about said rotational axis.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
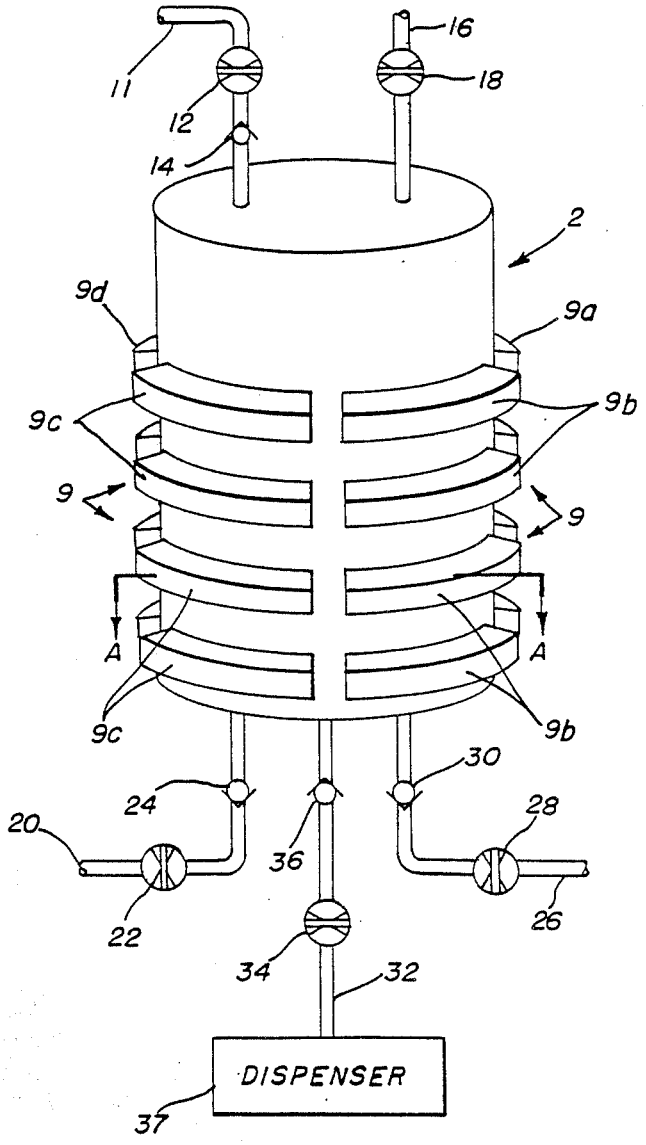
FIG. 1 is a diagramatic view of the carbonator system of the present invention.
Figure 3:
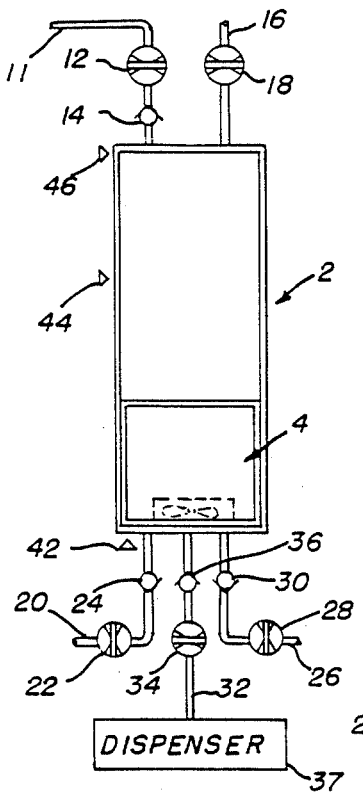
FIG. 3 is a schematic diagram of the carbonator system of the present invention.
Figure 4:
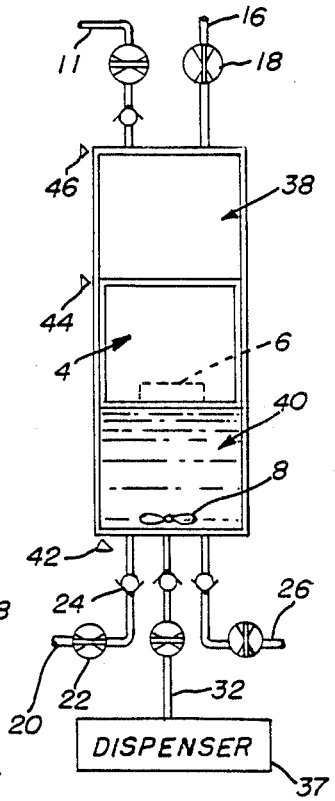
FIG. 4 is a schematic diagram of the carbonator system of the present invention wherein water is introduced into the holding tank.
Figure 5:
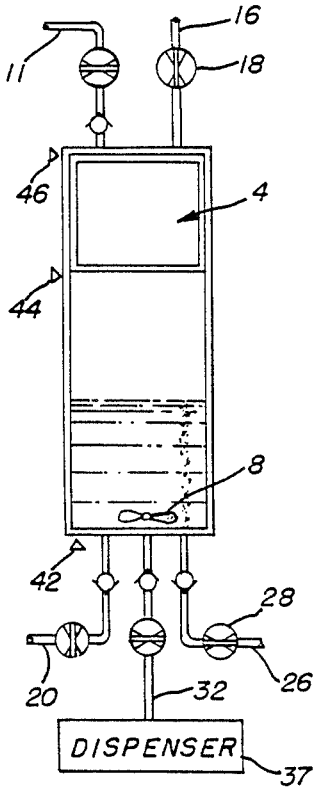
FIG. 5 is a schematic diagram of the carbonator system of the present invention wherein carbon dioxide is introduced into the holding tank.

Referring in detail to the drawings and with particular reference to FIGS. 1 and 3, a carbonator system is shown having a holding tank 2. This holding tank has a reciprocating piston 4. This piston separates holding tank 2 into an upper chamber 38 and a lower chamber 40 as seen in FIG. 4. Piston 4 reciprocates from a position against the lower end of the tank as shown in FIG. 3 to a position against the upper end of the tank as shown in FIG. 5. This piston 4 has a recessed portion 6. This recessed portion receives an agitator mixing bar 8 when the piston is at the lower end of tank 2. Agitator mixing bar 8 may be affixed to the bottom of tank 2 or be longitudinally movable in chamber 40 as will be described hereinafter.

Figure 2:
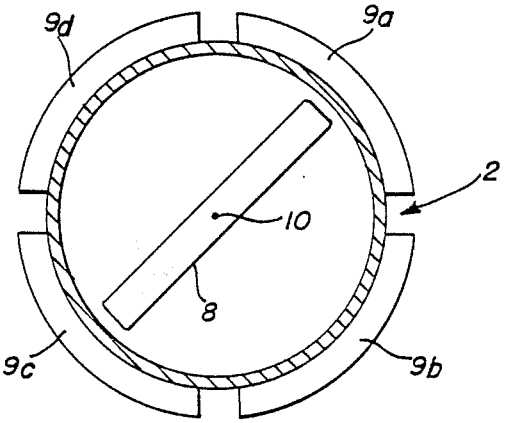
FIG. 2 is a cross sectional view taken along line A—A of FIG. 1.

As seen in FIGS. 1 and 2, an agitator 7 is provided with an agitator mixing bar 8. This agitator mixing bar 8 is disposed in the lower chamber 40 of holding tank 2. Mixing bar 8 is rotatable about a rotational axis 10 located in the center of this bar. Disposed on the exterior of holding tank 2 are a plurality of electro-magnetic coils 9. In FIG. 1, a series of four sets of coils 9 are shown. As can be seen in FIG. 2, each set of coils consists of four individual coils surrounding the periphery of holding tank 2. While only four sets of coils are disclosed and while only four coils are disclosed in each set, it is contemplated that fewer or additional coils may be used in the carbonator system of the instant invention. Each set of coils is disposed on a horizontal plane substantially perpendicular to the longitudinal axis of the holding tank 2. This longitudinal axis is coincident with rotational axis 10.

Agitator bar 8 has both a magnetic north and a magnetic south pole which will be influenced by the electromagnetic coils as will be explained. In particular, a typical operation sequence would find opposing coils in one horizontal plane energized in such a manner that one coil would be a magnetic north pole and the other coil would be a magnetic south pole. In particular, coils 9*a* and 9*c* of FIG. 2 would be energized while coils 9*b* and 9*d* would not be energized. The magnetic field generated would align the agitator bar 8 as shown. Then the coils 9*b* and 9*d* immediately adjacent the energized coils would be energized. Simultaneously, the initially magnetized coils 9*a* and 9*c* would be deactivated. By deenergizing these coils, rotation of the agitator bar 8 would result. Rapid energizing and deenergizing of the four coils in the horizontal plane would cause rapid spinning of the agitator bar 8 in a single horizontal plane.

By energizing coils at different levels, the agitator can be moved along the longitudinal axis of the holding tank 2. In other words, by energizing and deenergizing coils in various horizontal planes, the agitator bar 8 may be vertically adjusted along the length of the tank 2 in lower chamber 40 if so desired. The controls for this agitator will be described later.

This coil arrangement has only on moving part and no seals which is of significant benefit. This design provides for simple yet effective mechanical agitation of material in holding tank 2.

As seen in FIGS. 3–8, the holding tank 2 has a propellant fluid inlet 11. The propellant fluid may consist of pressurized $CO_2$ or air or water or any other suitable material. This propellant fluid will only be held in the upper chamber 38 of tank 2. When gas inlet valve 12 is open, this propellant fluid may enter chamber 38. A check valve 14 is provided to prevent propellant fluid within chamber 38 from exiting through inlet 11. A propellant fluid outlet 16 is also provided. This outlet has a outlet valve 18 for controlling flow of fluid therethrough. through.

Holding tank 2 also has a water inlet 20 for feeding water into its bottom chamber 40. This water inlet 20 has a water inlet valve 22 and water inlet check valve 24. A carbon dioxide inlet 26 is also provided for feeding carbon dioxide to lower chamber 40. This carbon dioxide inlet has a carbon dioxide inlet valve 28 and carbon dioxide inlet check valve 30. A carbonated water outlet 32 is also provided for the lower chamber 40. This carbonated water outlet 32 has an outlet valve 34 and check valve 36. Carbonated water outlet 32 feeds carbonated water from the lower chamber 40 to a dispenser 37.

Holding tank 2 has position sensors 42, 44 and 46 for detecting the position of piston 4. Position sensor 42 is provided at the lower end of the holding tank 2. Position sensor 44 is midway along the length of tank 2 while position sensor 46 is located at the upper end of holding tank 2. These position sensors operate with the control means. The operation of this control means will be set forth in more detail below.

The operation of the embodiment shown in FIGS. 3–8 will now be described. As seen in FIG. 3, piston 4 is located adjacent the bottom of holding tank 2. All valves are closed in this position. Then, propellant fluid outlet valve 18 in propellant fluid outlet 16 is opened. This allows any propellant fluid in upper chamber 38 to be vented to atmosphere in the case of gas propellants, or into a low pressure line in the case of a liquid propellant. Water inlet valve 22 is then opened. Still water at 32° F. enters the lower chamber 40 of holding tank 2. This water raises piston 4 to the position shown in FIG. 4.

When position sensor 44 detects the presence of the piston, water inlet valve 22 is then closed and the piston is exactly half-way up the carbonator. The lower chamber 40 may contain 21 cubic inches of water (for example) at this stage.

Carbon dioxide inlet valve 28 is then open. This permits carbon dioxide at 22 psi (for example) to enter the lower chamber 40 of holding tank 2. This action pushes piston 4 to the top of holding tank 2 as seen in FIG. 5. As the piston 4 is moved upwardly, any propellant fluid in upper chamber 38 may be vented to atmosphere (see above) through open propellant fluid outlet valve 18. When the piston reaches the upper end of holding tank 2, the tank may contain 21 cubic inches of $CO_2$ at 22 psig for example, in addition to the 21 cubic inches of still water.

As an example, 22 psig approximately equals 2.5 atmospheres (absolute), 21 cubic inches of carbon dioxide at 2.5 atmospheres when dissolved into 21 cubic inches of water causes the water to carbonate to approximately 2.5 volumes. Different levels of carbonation can be achieved by varying the pressure of the 21 cubic inches of $CO_2$.

Accordingly, as soon as the piston has reached the upper end of holding tank 2 as determined by position sensor 46 and the pressure inside the carbonator has stabilized, valves 18 and 28 are immediately shut off. Stabilization of pressure occurs a few seconds after the piston 4 reaches the upper end of holding tank 2. After valve 18 and 28 are closed, agitator bar 8 is activated. Agitation of the agitator mixing bar 8 aids the formation of carbonated water.

Figure 6:
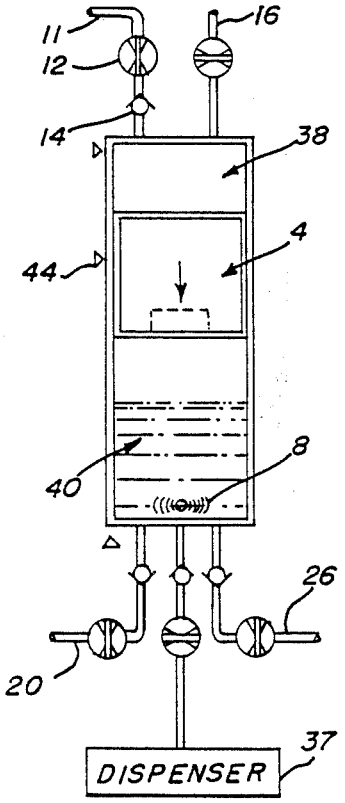
FIGS. 6 and 7 are schematic diagrams of the carbonator system of the present invention wherein carbon dioxide is driven into a solution to form carbonated water.
Figure 7:
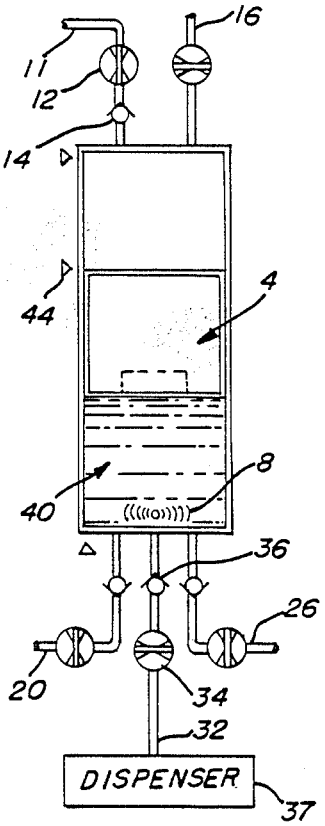
Figure 8:
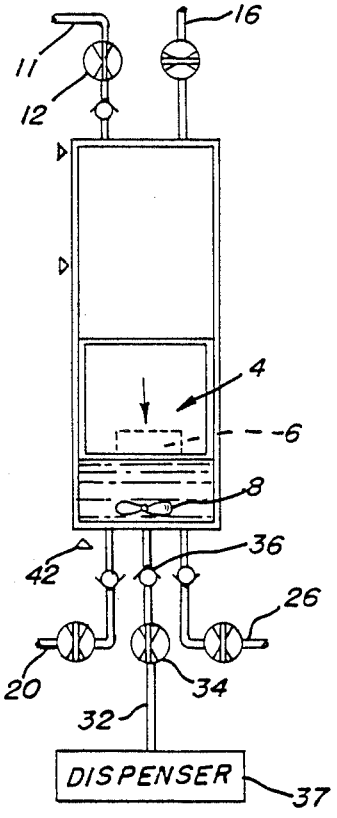
FIG. 8 is a schematic diagram of the carbonator system of the present invention wherein carbonated water is dispensed from the holding tank.

As soon as the agitator is activated valve 12 may be open to counter pressurize the top side of the piston 4 as indicated in FIG. 6. Propellant fluid will be infed through inlet 11 when valve 12 is open. This fluid may be at a pressure of 50 psig for example. The high pressure of the propellant fluid will cause the piston to move downwardly which will result in an increase in the pressure in lower chamber 40. The pressure is raised significantly higher than the saturation pressure for the volume of carbon dioxide at 32° F. in the lower chamber 40. Thus, the $CO_2$ is forced into solution. As seen in FIG. 7, the piston 4 will eventually reach the surface of fluid contained in chamber 40. In this situation, all of the carbon dioxide will have been driven into solution. Valve 12 remains open after the piston 4 reaches the level of fluid in order to insure that the system remains counter pressurized to a level above the saturation pressure. Accordingly, no separation between the carbon dioxide and water will occur.

The solution in chamber 40 of FIG. 7 consists of fully carbonated water which is ready to be dispensed. In order to dispense this water, agitator bar 8 is deactivated and carbonated water outlet valve 34 is opened. Carbonated water may then flow through outlet 32 to dispenser 37. To insure dispensing of this carbonated water, the valve 12 remains open. Thus, the pressure of the propellant fluid forces the piston 4 towards the lower end of chamber 40. When the piston 4 reaches the bottom of the dispenser as indicated by position sensor 42, valves 34 and 12 are closed as indicated in FIG. 3. This, cycle for carbonation of water may be then be repeated.

Figure 9:
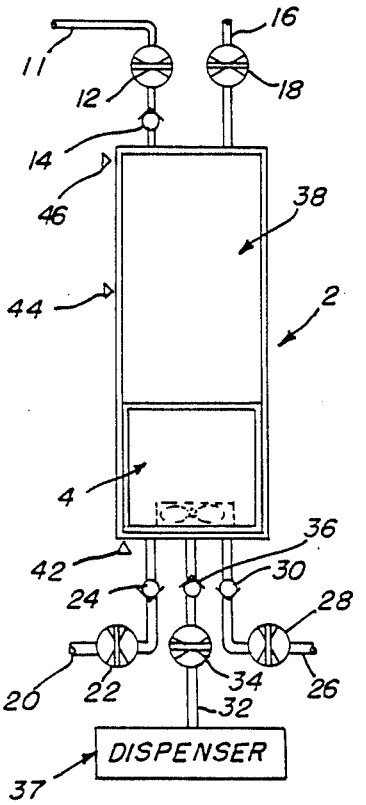
FIG. 9 is a schematic diagram of a second embodiment of the carbonator system of the present invention.
Figure 10:
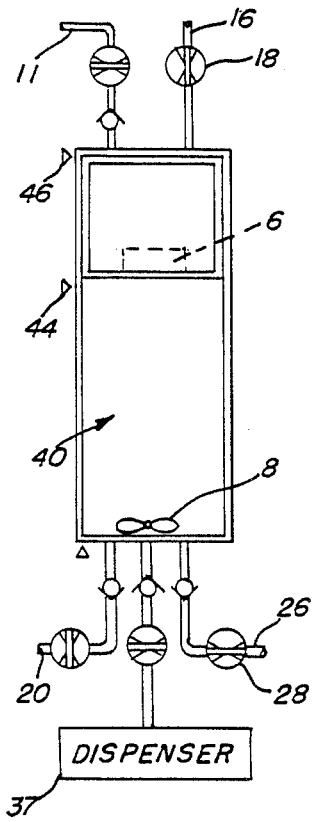
FIG. 10 is a schematic diagram of the embodiment of FIG. 9 of the present invention wherein carbon dioxide is introduced into the holding tank.

A second arrangement for carbonating water is shown in FIG. 9–13. This arrangement uses the same structure as the first embodiment but, this structure is operated in a different manner. With reference to FIGS. 9–13, the operation for this embodiment will now be described. As seen in FIG. 9, the piston 4 is initially against the lower end of holding tank 2. All valves are closed in this position. Next, propellant fluid outlet valve 18 is opened and carbon dioxide inlet valve 28 is open. This action forces piston 4 against the upper end of tank 2. Lower chamber 40 is completely filled with carbon dioxide as seen in FIG. 10. This carbon dioxide may be at a pressure of 22 psig, for example. The piston 4 moves from its FIG. 9 to its FIG. 10 position by the force of the carbon dioxide entering the chamber 40. Any propellant fluid above piston 4 in upper chamber 38 opened exits through opened gas outlet 16.

Figure 11:
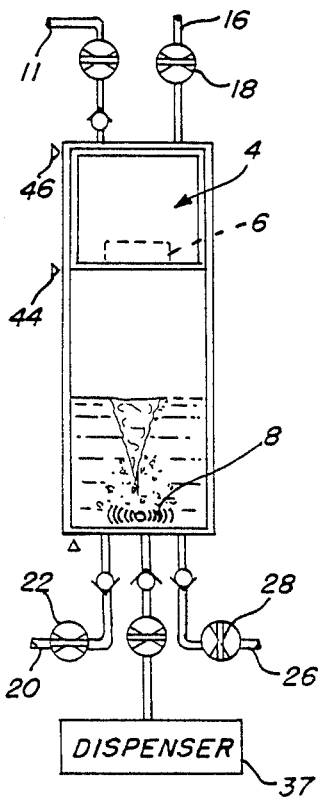
FIG. 11 is a schematic diagram of the embodiment of FIG. 9 of the present invention wherein water is introduced into the holding tank.

Valves 18 and 28 are then closed and valve 22 is then opened. This permits water to enter the lower chamber 40 at 50 PSIG, for example. The agitator bar 8 will then be activated. This agitator aids mixing of water and carbon dioxide as indicated in FIG. 11. As water fills the holding tank 2, the carbon dioxide will be absorbed into the water in order to form carbonated water.

Figure 12:
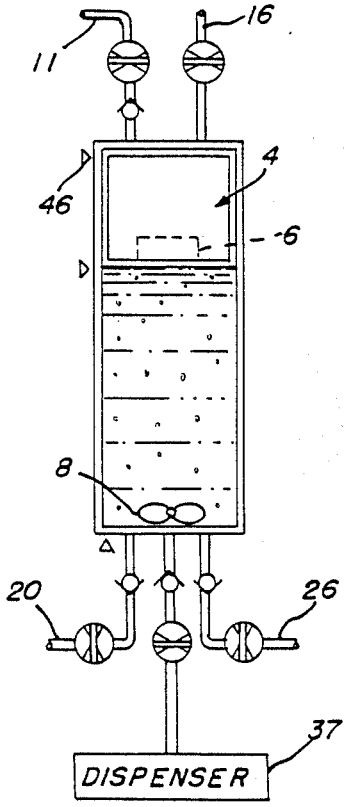
FIG. 12 is a schematic diagram of the embodiment of FIG. 9 of the present invention wherein the holding tank is filled with carbonated water.

When the cylinder is completely filled with water, all of the $CO_2$ will have been driven into solution. The water now is carbonated to 2.5 volumes for example. Valve 22 will be closed and the agitator bar 8 will be deactivated as indicated in FIG. 12.

Figure 13:
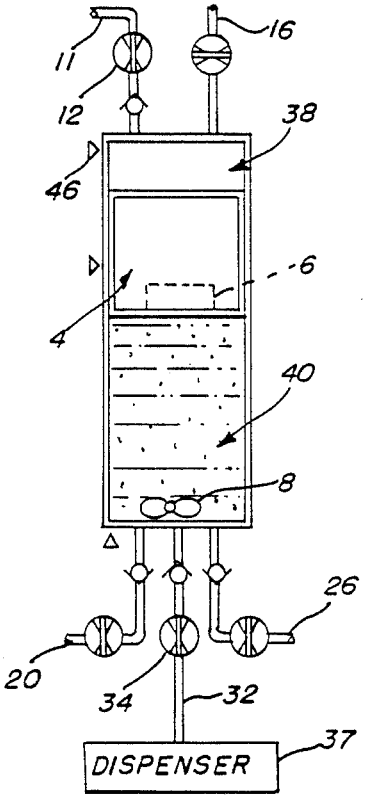
FIG. 13 is a schematic diagram of the embodiment of FIG. 9 showing the carbonator system of the present invention wherein carbonated water is being dispensed from the holding tank.

When it is desired to dispense the carbonated water in chamber 40 to a dispenser 37, valve 34 and valve 12 may be opened. When valve 12 is opened, propellant fluid enters upper chamber 38 through inlet 11. This fluid is at a pressure substantially higher than the saturation pressure of the carbonated water. For instance, the propellant fluid may be at 50 psi. The pressure of the propellant fluid counter pressurizes the piston forcing it downwardly. After valve 34 is opened, piston 4 will move downwardly and carbonated water will be discharged from tank 2 through outlet 32 to dispenser 37 as seen in FIG. 13. Valve 34 may be closed to cease dispensing of the carbonated water. However, valve 12 will remain open in order to pressurize the top of the cylinder 4 and to maintain the carbonation of the solution in chamber 40. When the piston 4 reaches the bottom of holding tank 2, all of the carbonated water will be discharged to dispenser 37. Valves 12 and 34 will be closed. This arrangement is shown in FIG. 9. The carbonator is now empty and the cycle may be repeated.

Either one of the two carbonator embodiments can each be used to fill a large holding tank from which drinks can be drawn to a user's cup. Alternatively, it is contemplated that two carbonators could be used in parallel. While one is carbonating the water, the other would be dispensing already carbonated water.

Figure 14:
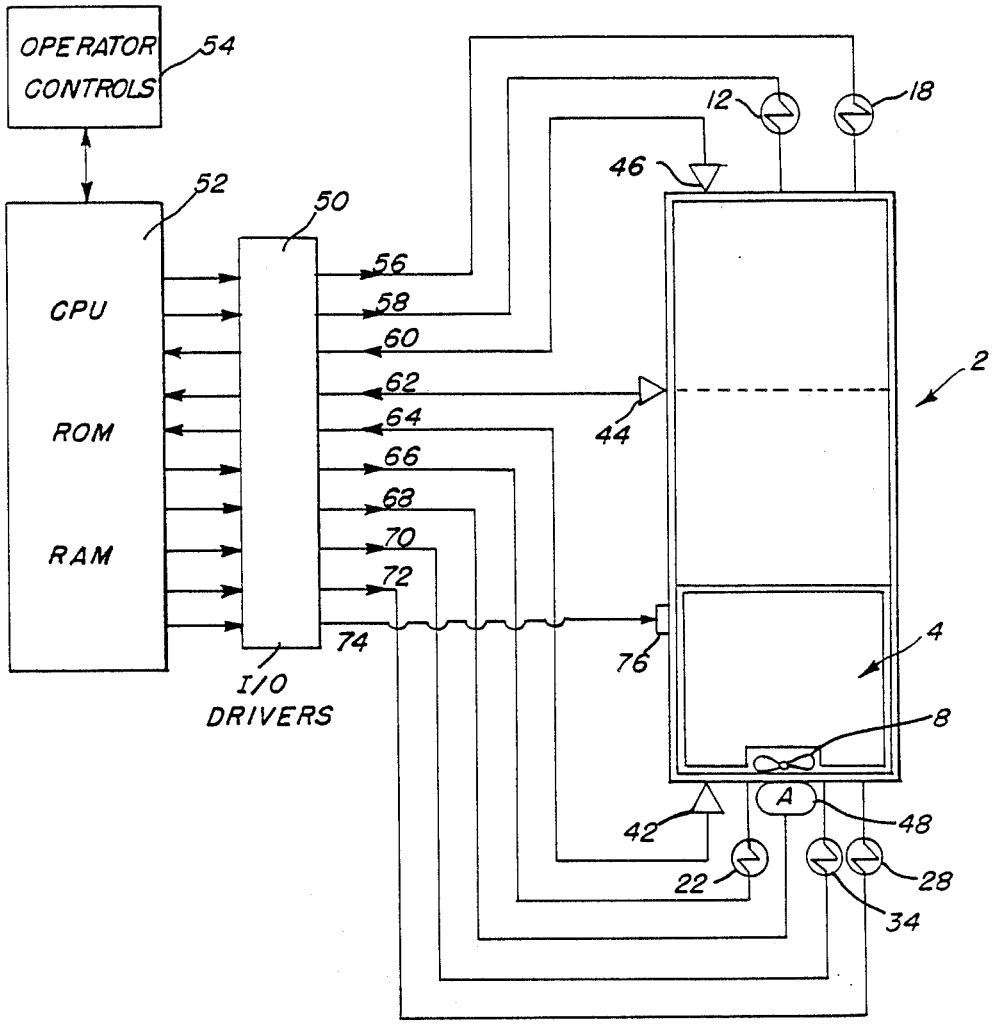
FIG. 14 is a schematic diagram of the control system of the carbonator system of the present invention.

In order to control operation of the carbonator, a control system is shown in FIG. 14. The electrical logic to operate the carbonator of the present invention can be implemented with discrete logic components or with a conventional microprocessor with support chips or with the newer "single chip" microcontrollers.

As shown in FIG. 14, a microcontroller 52 is connected to an operator controls 54. This mircrocontroller 52 consists of a CPU (Central Processing Unit), a ROM (Read Only Memory), a RAM (Random Access Memory) and I/O (Input/Output) ports built into a single chip. Input/Output drivers 50 are connected to the microcontroller 52. Also shown in FIG. 14 is holding tank 2 with the piston 4 in its lower position. Five solenoid valves 12, 18, 22, 34, and 28 are indicated which correspond to the foregoing discussed valves. Position sensors 42, 44 and 46 are also disclosed for detecting the position of moveable piston 4. Also shown is an agitator bar 8 with a agitator drive means 48. Such an agitator drive means corresponds to a conventional motor drive for a fixed agitator bar. However, the control system is also capable of controlling the above discussed agitator 7 which uses electro-magnetic coils 9. These coils 9 have been schematically represented by numeral 76 in FIG. 14. It should be understood that if the electro-magnetic coil agitator arrangement is used, the agitator bar 8 would not be affixed to the lower end of holding tank 2 and a separate drive 48 would be unneccessary.

Also shown in FIG. 14 are lines 56,58,60,64,66,68,70, 72 and 74. It should be noted that of lines 68 and 74, that only one will be used in a particular control system depending upon the type of agitator used.

The operation of the carbonator control system will now be disclosed. Upon initializaton (start up) the microcontroller via position sensor 42 detects the piston at the lower end of holding tank 2. The position sensor 42 signals the I/O drivers 50 to deenergize (close) all five solenoid valves 12, 18, 22, 28 and 34. After a programmed length of time, valve 18 is energized (open) by the controller via I/O driver 50 and line 56. This permits venting of the upper chamber 38. For the sake of brevity, when a solenoid is described as being energized or deenergized it should be understood that the signal originates from the microcontroller 52 and is transferred to the solenoid via the I/O driver 50.

With regard to the control system for the first embodiment, water inlet valve 22 will be energized (opened) allowing "still water" at approximately 32° F. to enter the carbonator. This water will force piston 4 away from the agitator end of holding tank 2. When the piston is midway into the carbonator, position sensor 44 detects it and signals the controller via line 62. The controller then deenergizes (closes) water valve 22 via line 66. The carbonator now contains a known amount of still "water".

Solenoid valve 28 is then energized (open) via line 72. Opening of this valve 28 allows the introduction of carbon dioxide into the lower chamber 40 of holding tank 2. The carbon dioxide continues the piston displacement started by the water until the piston reaches the end of its travel in the carbonator housing. Position sensor 46 detects the pistons location and after an appropriate time delay for pressure stablization signals the controller via line 60 to deenergize (close) vent valve 18 and carbon dioxide inlet valve 28. The microcontroller 52 then starts the agitator bar 8.

As noted above, either agitator drive 48 or 76 would be used in a particular holding tank 2. If agitator 48 is used, this agitator will be activated via the line 68. If, on the other hand, an agitator 76 is used, line 74 will be used to activate this agitator. In either arrangement, activation of the agitator aids carbonization of the water.

When the microcontroller 52 starts the agitator, valve 12 is energized (open) via line 58. Opening of this valve 12 permits propellant fluid to enter the upper chamber 38 and to counter pressurize the face of piston 4. The action of the agitator and of the propellant fluid on piston 4 acts to force the carbon dioxide in the lower chamber 40 into solution. Thus, carbonated water is formed.

When all the carbon dioxide has been forced into solution, the sensor 44 detects the position of the piston 4. A signal is sent via line 62 to microcontroller 52. The microcontroller 52 then deenergizes (shuts off) the agitator and energizers (opens) valve 34. By opening valve 34, dispensing of carbonated water is initiated. Dispensing of carbonated water may be intermittant or continuous. When all the carbonated water has been dispensed from the lower chamber 40. The piston will reach the agitator end of holding tank 2. The position sensor 42 will signal the microcontroller 52 to then deenergize (close) valve 34. All solenoid valves are now deenergized and the operating cycle is ready to be repeated.

From the foregoing, it can be seen that the control system disclosed in FIG. 14 could readily be used to control operation of the second embodiment of the carbonator of the instant invention as shown in FIG. 9–13. In operation of this embodiment, the microcontroller 52 will first energize (open) valves 18 and 28. The lower chamber 40 of holding tank will be filled with carbon dioxide. When the position sensor 46 determines that the piston 4 has reached the upper end of holding tank 2, valve 28 will be deenergized (closed). After a suitable delay, valve 22 may then be open to permit water to fill the lower chamber 40. Simulataneously agitator bar 8 is activated. As water enters the lower chamber 40, the carbon dioxide is forced into solution. After an appropriate length of time to allow the chamber to become completely filled, valve 22 will be closed.

When all the carbon dioxide in tank 2 has been driven into solution, valves 12 and 34 may be energized (open) bY the microcontroller 52. This arrangement will permit dispensing of the carbonated water.

The control system of the instant invention utilizes solenoid valves that must be energized in order to open. This design has the benefit that a power interruption will merely result in the valves being safely in the closed (shut-off position). A non-volatile RAM will be incorporated in applications that are intolerant of insufficiently carbonated water that may result from a power interruption. The nonvolatile RAM will retain the position of the cycle during which the interruption occurred. Thus, this RAM will allow the orderly resumption of the cycle when power is restored.

It should be understood that the carbonator system, control system, and agitator of the present invention may be utilized in the microgravity conditions of outer space as well as on earth. Also, it is contemplated that a plurality of holding tanks may be used. For instance, two holding tanks may be used in parallel such that while one is carbonating water, the other holding tank may be dispensing already carbonated water. While this carbonator system has been disclosed for dispensing carbonated water, any other known solutions may be handled by this system. Furthermore, as this invention is contemplated for use in outer space, it should be noted that any recitation to upwardly or downwardly contained within the specification has merely been made with reference to the attached drawings.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A carbonator system for producing carbonated water comprising:

holding tank means for holding at least water and carbon dioxide;

a movable piston separating said holding tank means into two chambers, including a first chamber for holding a propellant fluid and a second chamber for holding carbon dioxide and water; and control means for controllng flow of propellant fluid into and out of said first chamber and selectively controlling flow of carbon dioxide and water into said second chamber, the flow of carbon dioxide and water being selectively controlled independently of each other by said control means, at least one of said carbon dioxide and water being received in said second chamber as said propellant fluid is discharged from said first chamber, said control means permitting said water and carbon dioxide to be held in said second chamber for a sufficient time to form carbonated water, the carbon dioxide being completely absorbed in the water when said carbonated water is formed thereby avoiding formation of a headspace in said second chamber, and said control means selectively controlling discharge of carbonated water formed from said water and carbon dioxide from said second chamber.

2. The carbonator system as recited in claim 1, wherein agitator means for assisting mixing of the water and carbon dioxide to form the carbonated water is provided in said second chamber.

3. The carbonator system as recited in claim 2, wherein said agitator means further comprises;

a plurality of electro-magnetic coils surrounding a portion of said holding tank means;

an agitator mixing bar having a magnetic north pole and a magnetic south pole, said bar being disposed within said second chamber of said holding tank means, and said bar being rotatable about a rotational axis; and said control means being capable of selectively activating and deactivating each of the plurality of electro-magnetic coils in order to cause said agitator mixing bar to rotate about said rotational axis.

4. The carbonator system as recited in claim 3, wherein said plurality of coils includes at least four coils arranged in one plane and wherein said control means activates two of said at least four coils while remaining coils are deactivated and thereafter, said control means activates the remaining coils and deactivates said two of said at least four coils, said two of said at least four coils and said remaining coils being situated to cause said agitator mixing bar to rotate by magnetic force upon said activation and deactivation of the coils.

5. The carbonator system as recited in claim 4, wherein other planes containing at least four coils each are provided in addition to said one plane, all of said planes being generally parallel and noncoincident.

6. The carbonator system as recited in claim 5, wherein said agitator mixing bar is suspended in the lower chamber of said holding tank means via magnetic force from activated electro-magnetic coils and wherein coils in different planes may be selectively activated by said control means in order to reciprocate said agitator bar along the rotational axis, said holding tank means having a longitudinal axis and said rotational axis and said longitudinal axis being coincident.

7. The carbonator system as rectied in claim 1, wherein said first chamber of said holding tank receives said propellant from a first source and said second chamber of said holding tank receives carbon dioxide and water from at least a second source and said first source is separate from said second source.

8. The carbonator system as recited in claim 1, wherein said holding tank means dispenses carbonated water to a dispenser.

9. The carbonator system as recited in claim 1, wherein said system is for use in the microgravity conditions of outer space.

10. A control system for a carbonator having a first and second chamber wherein carbon dioxide and water are mixed in said second chamber to form carbonated water, said system comprising;

movable partition means for separating said first and second chambers;

control means for directing operation of said carbonator;

a first valve for permitting propellant fluid to enter said first chamber when said first valve is open;

a second valve for permitting said propellant fluid to exit said first chamber when said second valve is open;

a third valve for permitting said water to enter said second chamber when said third valve is open;

a fourth valve for permitting said carbon dioxide to enter said second chamber when said fourth valve is open;

a fifth valve for permitting said carbonated water formed from said water and carbon dioxide to exit said second chamber when said fifth valve is open; and means to interface the control means with the first, second, third, fourth and fifth valves to enable said control means to open and close said valves.

11. The control system as recited in claim 10, wherein said movable partition comprises a piston, said piston being movable between said first and second chambers, said piston defines volume of each of said chambers and is movable in response to introduction and exit of at least one of said propellant fluid, said water, said carbon dioxide and said carbonated water, said control system further comprising:

sensor means for detecting the position of the piston, said control means being responsive to information received from said sensor means during operation of said carbonator.

12. The control system as recited in claim 11, wherein said control means opens said second valve and thereafter opens said third valve to permit water to enter said second chamber, upon receiving a signal from the sensor means indicating the piston has reached a first desired position, the control means closes said third valve and opens said fourth valve, said piston then moving to another position which is sensed by the sensor means, said sensor means sending a signal to said control means which closes said fourth valve and opens said first valve to move the piston back to the first desired position due to the force of propellant fluid entering the first chamber, said control means then activating an agitator in the second chamber to aid formation of carbonated water and after a predetermined time, said control means opens said fifth valve and said first valve to permit discharge of said carbonated water from said second chamber and to permit introduction of additional propellant fluid to said first chamber.

13. The control system as recited in claim 11, wherein said control means opens said second and fourth valves to permit carbon dioxide to enter said second chamber and move said piston to a desired position, said sensor means thereafter detecting said piston reaching said desired position and sending a signal to said control means, said control means thereafter closing said second and fourth valve and opening said third valve while simultaneously activating an agitator to aid in mixing of the water and carbon dioxide to form carbonated water, until said second chamber is filled with water, said control means thereafter closing said third valve and opening said first and fifth valve to permit discharge of said carbonated water from said second chamber and introduction of propellant fluid to said first chamber.

14. The control system as recited in claim 10, wherein said carbonator is for use in the microgravity conditions of outer space.

15. The control system as recited in claim 10, further comprising:

agitator means for assisting mixing of said water and carbon dioxide in said second chamber to form carbonated water, said agitator means includes a mixing bar; and said control means being connected to said agitator means to control operation of the mixing bar.

16. The control system as recited in claim 15, wherein said agitator means further comprises:

a plurality of electro-magnetic coils surrounding at least said first chamber;

said agitator mixing bar having a magnetic north pole and a magnetic south pole, said bar being disposed within said second chamber and said bar being rotatable about a rotational axis; and said control means selectively activating and deactivating each of said plurality of electro-magnetic coils in order to cause said agitator mixig bar to rotate about said rotational axis.

17. The control system as recited in claim 16, wherein said plurality of coils includes at least four coils disposed in a plane and said control means activates two oppositely disposed coils while remaining coils in said plane are deactivated and thereafter, said control means activates the remaining coils and deactivates said two of said at least four coils in said plane, said coils in said plane being arranged to cause said agitator mixing bar to rotate by magnetic force upon said activation and deactivation of the coils.

18. The control system as recited in claim 10, wherein said control means includes at least central processing unit, read only memory, random access memory and input/output ports.

19. An agitator for a carbonator for mixing carbon dioxide and water to form carbonated water, said agitator aiding the formation of carbonated water and comprising:

a plurality of sets of electro-magnetic coils surrounding the carbonator at different intervals along the length thereof;

an agitator mixing bar disposed in said carbonator, said bar having a magnetic north pole and a magnetic south pole and having a rotational axis; and control means for directing operation of said carbonator, said control means selectively activating and deactivating each of said electro-magnetic coils in a set thereof to cause said mixing bar to rotate about said rotational axis and selectively activating and deactivating selected sets to reciprocate said mixing bar along said rotational axis.

20. The agitator as recited in claim 19, wherein said plurality of coils of each set includes at least four coils and said control means activates two of said at least four coils of the selected set while remaining coils of said selected set are deactivated and thereafter, said control means activates the remaining coils of said selected set and deactivates said two of said at least four coils of said selected set, said two of said at least four coils and said remaining coils of said selected set being situated to cause said agitator mixing bar to rotate by magnetic force upon said activation and deactivation of the coils.

21. The agitator as recited in claim 20, wherein said at least four coils of each set are arranged in one plane and all of said planes are generally parallel and noncoincident.

22. The agitator as recited in claim 21, wherein said agitator mixing bar is suspended in the carbonator via magnetic force from activated electro-magnetic coils and wherein coils in different planes may be selectively activated by said control means in order to reciprocte said agitator mixing bar along the rotational axis, said carbonator having a longitudinal axis and said rotational axis and said longitudinal axis being coincident.

23. The agitator as recited in claim 19, wherein said agitator is for use in the microgravity conditions of outer space.

24. An agitator for a carbonator for mixing carbon dioxide and water to form carbonated water, said agitator aiding the formation of carbonated water and comprising:

an agitator mixing bar disposed in said carbonator, said mixing bar having a magnetic north pole and a magnetic south pole and having a rotational axis therethrough;

coil means for suspending and for rotating said mixing bar in the carbonator via magnetic force, said coil means partially surrounding said carbonator and being located at different levels of said carbonator; and control means for activating and deactivating portions of said coil means at each level to cause mixing bar to rotate about said rotational axis and for selectivley activating one of said levels of said plurality of coil means in order to reciprocate said mixing bar along the rotational axis, said carbonator having a longitudinal axis and said rotational axis and said longitudinal axis being coincident.

25. The agitator as recited in claim 24, wherein said different levels comprise generally parallel, noncoincident planes within which at least one of each of said plurality of coil means is positioned.

26. The agitator as recited in claim 24, wherein said coil means comprises a plurality of electro-mechanical coils, said plurality of electro-mechanical coils being positioned so that each of said levels of said coil means contains at least one electro-mechanical coil.

27. The agitator as recited in claim 24, wherein said agitator is for use in the microgravity conditions of outer space.

* * * * *